US008597114B2

(12) United States Patent
Snow

(10) Patent No.: US 8,597,114 B2
(45) **Date of Patent: *Dec. 3, 2013**

(54) SYSTEMS AND METHODS FOR ASSISTING PLAYERS IN ARRANGING HANDS FOR TABLE GAMES

(75) Inventor: Roger M. Snow, Las Vegas, NV (US)

(73) Assignee: SHFL Entertainment, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/592,477

(22) Filed: Aug. 23, 2012

(65) Prior Publication Data

US 2013/0035148 A1 Feb. 7, 2013

Related U.S. Application Data

(63) Continuation of application No. 12/759,416, filed on Apr. 13, 2010, now Pat. No. 8,251,802, which is a continuation-in-part of application No. 12/572,205, filed on Oct. 1, 2009, now Pat. No. 8,342,529, which is a continuation-in-part of application No. 12/218,583, filed on Jul. 15, 2008, now Pat. No. 8,262,475.

(51) Int. Cl.
*A63F 9/24* (2006.01)

(52) U.S. Cl.
USPC ..... 463/25; 463/22

(58) Field of Classification Search
USPC ..... 463/25, 22, 47; 273/149 R
See application file for complete search history.

(56) References Cited

U.S. PATENT DOCUMENTS

| | | | |
|---|---|---|---|
| 1,831,580 | A | 11/1931 | Stecker |
| 2,023,210 | A | 12/1935 | Potter |
| 2,666,645 | A | 1/1954 | Phillips |
| 3,222,071 | A | 12/1965 | Lang |
| 3,735,982 | A | 5/1973 | Gerfin |
| 3,810,627 | A | 5/1974 | Levy |

(Continued)

FOREIGN PATENT DOCUMENTS

| | | |
|---|---|---|
| EP | 1 814 091 | 8/2007 |
| WO | 0230529 | 4/2002 |

(Continued)

OTHER PUBLICATIONS

Brochure from TCS/John Huxley for Touch Table MultiPLAY™ Roulette, prior to 2007, 2 pages.

(Continued)

*Primary Examiner* — Pierre E Elisca
(74) *Attorney, Agent, or Firm* — TraskBritt

(57) ABSTRACT

A system and method for enabling play of a casino table card game. Multiple randomized sets of playing cards of known composition are formed and delivered, and are set by following automatically generated house way instructions. An automatic card shuffler is configured to deliver randomized sets of physical cards, the shuffler equipped with a playing card reading system that reads at least one of a rank and suit of markings on each of the playing cards. A processor receives the read card information from the playing card reading system and determines a composition of each individual set of playing cards dispensed. At least one display is in communication with a processor programmed with house way rules for displaying instructions on how to set hands from a distributed set of cards a house way. Processors of the present invention may also cause a display of a house commission amount.

20 Claims, 7 Drawing Sheets

(56) References Cited

U.S. PATENT DOCUMENTS 3,876,208 A 4/1975 Wachtler et al.
3,909,002 A 9/1975 Levy et al.
4,339,798 A 7/1982 Hedges et al.
4,467,424 A 8/1984 Hedges et al.
4,497,488 A 2/1985 Plevyak et al.
4,531,187 A 7/1985 Uhland et al.
4,534,562 A 8/1985 Cuff et al.
4,614,342 A 9/1986 Takashima
4,711,371 A 12/1987 Harrigan
4,743,022 A 5/1988 Wood
4,750,743 A 6/1988 Nicoletti
4,755,941 A 7/1988 Bacchi
4,760,527 A 7/1988 Sidley
4,805,907 A 2/1989 Hagiwara
4,813,675 A 3/1989 Greenwood et al.
4,926,327 A 5/1990 Sidley
4,948,134 A 8/1990 Suttle et al.
5,022,653 A 6/1991 Suttle et al.
5,033,744 A 7/1991 Bridgeman et al.
5,067,713 A 11/1991 Soules et al.
5,224,706 A 7/1993 Bridgeman et al.
5,265,882 A 11/1993 Malek et al.
5,277,424 A 1/1994 Wilms
5,288,081 A 2/1994 Breeding et al.
5,299,803 A 4/1994 Halaby et al.
5,308,065 A 5/1994 Bridgeman et al.
5,326,104 A 7/1994 Pease et al.
5,328,189 A 7/1994 Malek et al.
5,356,140 A 10/1994 Dabrowski et al.
5,374,061 A 12/1994 Albrecht et al.
5,395,120 A 3/1995 Malek et al.
5,411,257 A 5/1995 Fulton et al.
5,411,270 A 5/1995 Naka et al.
5,437,451 A 8/1995 Fulton et al.
5,437,462 A 8/1995 Breeding et al.
5,586,766 A 12/1996 Forte et al.
5,586,936 A 12/1996 Bennett et al.
5,586,937 A 12/1996 Menashe
5,591,081 A 1/1997 Suzuki
5,605,334 A 2/1997 McCrea, Jr.
5,669,817 A 9/1997 Tarantino et al.
5,688,174 A 11/1997 Kennedy et al.
5,707,287 A 1/1998 McCrea et al.
5,722,893 A 3/1998 Hill et al.
5,735,525 A 4/1998 McCrea et al.
5,769,417 A 6/1998 Richer et al.
5,770,533 A 6/1998 Franchi et al.
5,779,546 A 7/1998 Meissner et al.
5,803,809 A 9/1998 Yoseloff
5,823,879 A 10/1998 Goldberg et al.
5,863,041 A 1/1999 Boylan et al.
5,863,042 A 1/1999 Lo et al.
5,911,626 A 6/1999 McCrea et al.
5,934,998 A 8/1999 Forte et al.
5,941,769 A 8/1999 Order et al.
5,975,528 A 11/1999 Halaby
6,004,205 A 12/1999 Lauretta et al.
6,039,650 A 3/2000 Hill et al.
6,074,720 A 6/2000 Van Stratum
6,093,103 A 7/2000 McCrea et al.
6,117,012 A 9/2000 McCrea et al.
6,165,069 A 12/2000 Sines et al.
6,196,547 B1 3/2001 Pascal et al.
6,254,484 B1 7/2001 McCrea, Jr.
6,270,404 B2 8/2001 Sines et al.
6,293,864 B1 9/2001 Romero
6,299,536 B1 10/2001 Hill
6,319,122 B1 11/2001 Packes, Jr. et al.
6,343,989 B1 2/2002 Wood et al.
6,346,044 B1 2/2002 McCrea, Jr.
6,386,973 B1 5/2002 Yoseloff
6,435,970 B1 8/2002 Baerlocher et al.
6,474,646 B1 11/2002 Webb
6,517,436 B2 2/2003 Soltys et al.
6,561,897 B1 5/2003 Bourbour et al.
6,565,432 B2 5/2003 Moody
6,575,831 B1 6/2003 Gonen et al.
6,582,301 B2 6/2003 Hill
6,626,757 B2 9/2003 Oliveras
6,651,985 B2 11/2003 Sines et al.
6,659,866 B2 12/2003 Frost et al.
6,666,765 B2 12/2003 Vancura
6,676,517 B2 1/2004 Beavers
6,688,597 B2 2/2004 Jones
6,722,974 B2 4/2004 Sines et al.
6,743,094 B2 6/2004 Johnson
6,758,751 B2 7/2004 Soltys et al.
6,835,133 B2 12/2004 Baerlocher et al.
6,896,620 B1 5/2005 Luciano et al.
6,921,337 B1 7/2005 Kennedy et al.
6,939,224 B2 9/2005 Palmer et al.
7,008,324 B1 3/2006 Johnson et al.
7,048,629 B2 5/2006 Sines et al.
7,195,244 B1 3/2007 Feola
7,198,569 B2 4/2007 Wolf et al.
7,201,655 B2 4/2007 Walker et al.
7,201,661 B2 4/2007 Kennedy et al.
7,217,187 B2 5/2007 Vancura
7,255,351 B2 8/2007 Yoseloff et al.
7,255,642 B2 8/2007 Sines et al.
7,316,615 B2 1/2008 Soltys et al.
7,325,806 B1 2/2008 Feola
7,361,086 B2 4/2008 Gazdic et al.
7,367,563 B2 5/2008 Yoseloff et al.
7,374,170 B2 5/2008 Grauzer et al.
7,407,438 B2 8/2008 Schubert et al.
7,451,987 B1 11/2008 Feola
7,481,434 B1 1/2009 Feola
7,559,839 B2 7/2009 Bahar
7,775,887 B2 8/2010 Kuhn et al.
7,803,051 B2 9/2010 Kuhn et al.
7,878,892 B2 2/2011 Sines et al.
8,016,659 B2 9/2011 Kuhn et al.
2001/0000118 A1 4/2001 Sines et al.
2002/0002072 A1 1/2002 Sines et al.
2002/0022510 A1 2/2002 Baerlocher et al.
2002/0068635 A1 6/2002 Hill
2002/0077170 A1 6/2002 Johnson et al.
2003/0003997 A1 1/2003 Vuong et al.
2004/0003395 A1 1/2004 Srinivas et al.
2004/0185933 A1 9/2004 Nicely
2004/0224777 A1 11/2004 Smith et al.
2004/0229682 A1 11/2004 Gelinotte
2005/0012270 A1 1/2005 Schubert et al.
2005/0062226 A1* 3/2005 Schubert et al. ..... 273/149 R
2005/0164759 A1 7/2005 Smith et al.
2005/0242500 A1 11/2005 Downs
2005/0272501 A1 12/2005 Tran et al.
2006/0025213 A1 2/2006 Kane et al.
2006/0030400 A1 2/2006 Mathis
2006/0084505 A1 4/2006 Yoseloff et al.
2006/0131809 A1 6/2006 Lancaster et al.
2006/0217188 A1 9/2006 Walker et al.
2006/0226604 A1 10/2006 Saucier
2006/0234796 A1 10/2006 Nobrega et al.
2006/0279040 A1 12/2006 Downs et al.
2006/0281537 A1 12/2006 Abbott et al.
2007/0057469 A1 3/2007 Grauzer et al.
2007/0069462 A1* 3/2007 Downs et al. ..... 273/149 R
2007/0072682 A1 3/2007 Crawford et al.
2007/0205559 A1 9/2007 Webb et al.
2007/0238504 A1 10/2007 Oliveras
2007/0256111 A1 11/2007 Medford et al.
2007/0275762 A1 11/2007 Aaltone et al.
2008/0006996 A1 1/2008 Frankel et al.
2008/0006998 A1 1/2008 Grauzer et al.
2008/0037628 A1 2/2008 Boyce et al.
2008/0051171 A1 2/2008 Lutnick et al.
2008/0076500 A1 3/2008 Lancaster et al.
2008/0076506 A1 3/2008 Nguyen et al.
2008/0111300 A1 5/2008 Czyzewski et al.
2008/0113764 A1 5/2008 Soltys
2008/0113772 A1 5/2008 Burrill et al.
2008/0113783 A1 5/2008 Czyzewski et al.

(56) References Cited

U.S. PATENT DOCUMENTS

| | | | | |
|---|---|---|---|---|
| 2008/0119257 | A1 | 5/2008 | Stern et al. | |
| 2008/0176617 | A1 | 7/2008 | Kekempanos et al. | |
| 2008/0258388 | A1 | 10/2008 | Schugar et al. | |
| 2008/0268933 | A1 | 10/2008 | Sines et al. | |
| 2008/0268939 | A1 | 10/2008 | Sines et al. | |
| 2008/0268940 | A1 | 10/2008 | Sines et al. | |
| 2008/0303210 | A1 | 12/2008 | Grauzer et al. | |
| 2009/0017888 | A1 | 1/2009 | Kuhn et al. | |
| 2009/0054161 | A1* | 2/2009 | Schubert et al. | 463/47 |
| 2009/0069090 | A1 | 3/2009 | Moser et al. | |
| 2009/0098932 | A1 | 4/2009 | Longway | |
| 2009/0115133 | A1 | 5/2009 | Kelly et al. | |
| 2009/0131151 | A1 | 5/2009 | Harris et al. | |
| 2009/0140492 | A1 | 6/2009 | Yoseloff et al. | |
| 2009/0191933 | A1 | 7/2009 | French | |
| 2009/0224476 | A1 | 9/2009 | Grauzer et al. | |
| 2009/0286585 | A1 | 11/2009 | Walker | |
| 2010/0016050 | A1 | 1/2010 | Snow et al. | |
| 2010/0062845 | A1 | 3/2010 | Wadds et al. | |
| 2011/0018195 | A1* | 1/2011 | Downs et al. | 273/149 R |
| 2011/0198805 | A1* | 8/2011 | Downs et al. | 273/149 R |

FOREIGN PATENT DOCUMENTS

| | | |
|---|---|---|
| WO | 2007/067213 | 6/2007 |
| WO | 2007/103351 | 9/2007 |
| WO | 2008/028148 | 3/2008 |
| WO | 2008/091809 | 7/2008 |
| WO | 2009/025673 | 2/2009 |

OTHER PUBLICATIONS

Dragon Bacc, brochure, pub. Feb. 16, 2007 (2 pgs); retrieved Feb. 4, 2010 from DigiDeal Corporation Web site: http://www.digideal.com/products/dragonbacc.php.

Extended European Search Report for corresponding EPO Application No. 10177548.4 dated Jan. 21, 2011; 8 pages.

International Search Report for PCT/US2009/050562 for Chipless Table Split Screen Feature, dated Sep. 1, 2009, 2 pages.

Nevada State Certificate of Registration for Trademark SAFEJACK to Mikohn Gaming Corporation of Las Vegas, Nevada dated Sep. 4, 1997.

Three (3) pictures taken of an Accuplay Table from TCS/John Huxley in use in an Arcade in Buylgaria, Feb. 2008.

* cited by examiner

SYSTEMS AND METHODS FOR ASSISTING PLAYERS IN ARRANGING HANDS FOR TABLE GAMES

CROSS-REFERENCE TO RELATED APPLICATIONS

This application is a continuation of U.S. patent application Ser. No. 12/759,416, filed Apr. 13, 2010, now U.S. Pat. No. 8,251,802, issued Aug. 28, 2012, which application is a continuation-in-part of U.S. patent application Ser. No. 12,572,205, filed Oct. 1, 2009, now U.S. Pat. No. 8,342,529, issued Jan. 1, 2013 and entitled Automated House-Way Indicator and Activator, which is a continuation-in-part of U.S. patent application Ser. No. 12/218,583, filed Jul. 15, 2008, now U.S. Pat. No. 8,262,475, issued Sep. 11, 2012 and entitled Chipless Table Split Screen Feature, the contents of each of which are hereby incorporated by reference in their entirety.

TECHNICAL FIELD

The present invention relates to the field of automated or semi-automated casino table card games and systems, particularly systems supporting play of games where players have multiple hands and in which players have input into the setting of assigned cards between the multiple hands. The present invention further relates to a system and apparatus for automatically generating instructions on how to set hands in a live card game or card game simulation and to provide specific instructions and information on amounts of commission or rake to be taken out of each winning wager.

BACKGROUND

There are many casino table card games disclosed in the patent literature that involve players being provided with packs of multiple cards and the opportunity to arrange those cards into multiple hands (e.g., two, three, four or more hands). Some of these games are widely played in the gaming industry. Examples of these games include public domain Pai Gow Poker, and a proprietary game called FORTUNE PAI GOW POKER®, which is described in U.S. Pat. No. 5,863,041.

These games involve play against a dealer hand, and the dealer hand is set according to predetermined casino rules, referred to in the art as the "house way." The term "house way" can include a variety of rules, such as when the dealer must take a hit card in the play of blackjack, the way the dealer must arrange a hand in the game of Pai Gow Poker, when a card must be discarded, etc. It is well known in the casino gaming industry that many games have house way rules that must be memorized by the dealer and followed to assure that the house maintains an edge in the game. In Pai Gow Poker, the player must also follow one important house way rule. That is, the rank of the two-card hand cannot exceed the rank of the five-card hand. Often, the dealer must assist the player in setting the hand. It has proven very difficult to teach dealers house way rules and consequently hands (both dealer and player) are not correctly set, and the time it takes to set the hands is too long. The house way rules are generally determined by the casino. For example, in the game of blackjack, some casinos require the dealer to hit on a soft 17, while others require the dealer to stand on the same dealer hand.

Pai Gow Poker and its variants are not as profitable to casinos as compared with other games because the players must make complex decisions on how to set hands. They may request the dealer help in setting the hands. When the dealer assists in setting a player hand the dealer is required to set the hand the house way. Anyone watching the play of Pai Gow Poker will observe players setting and resetting their two required hands, and then rechecking the hands after they have been laid on the table. This type of strategic decision-making activity is one of the reasons that Pai Gow Poker remains popular. Unfortunately, these decisions slow down the play of the game. This is particularly of concern to casinos as Pai Gow Poker has one of the lower profit margins in casinos, as compared to many other games. Because of the slow play, combined with the low profit margin, the game of Pai Gow Poker is not favored by casinos, even though it is very popular with customers.

Other games exist in the art that require hand setting. For example, a three-hand Pai Gow variant is described in Webb U.S. Pat. No. 6,474,646. In this game, players are required to set three hands to be played against a dealer's three hands (High, Mid and Low). U.S. Pat. No. 5,863,042 to Lo describes a poker game in which there is a primary wager and independent secondary wagers and player's set hands.

Schugar U.S. Patent Publication No. 2008/0258388 describes a wagering game that requires the dealer to discard cards according to a preset "house way."

Webb U.S. Patent Publication No. 2007/0205559 describes a wagering game in which the dealer sets and plays his hand according to predetermined house rules. The dealer then forms a dealer hand according to predetermined house way rules. The house way rules preferably require the dealer hand to stand under certain conditions.

In Saucier U.S. Patent Publication No. 2006/0226604, players place one or more wagers and opt whether to use a tiebreaker resolution. The banker may be required to set his or her hand according to a "house way" or "house rules."

Kane U.S. Patent Publication No. 2006/0025213 describes a system and method for playing a game of chance. In one example, a lottery game has a video poker secondary event. The poker game allows a player to arrange a plurality of virtual cards dealt to the player into a first hand and a second hand. Optionally, the player may select control 607 (e.g., a "HOUSE WAY" button) to arrange the cards into the first hand and the second hand according to the predefined set of rules.

U.S. Pat. No. 6,582,301 to Hill discloses a gaming system with a playing card delivery shoe. Among the other functions available in the system is a disclosed calculation and electronic displaying of commission(s) due the casino from each baccarat player, for example, using LED or LCD displays on the shoe or embedded in the game table, or even located remotely. Unpaid commissions can more readily be identified as well as the player owing the commission, which information can expedite collection and/or write-off of monies owed to the casino. Displayed information can also show detected (illegal) changes in the bet amounts or the type of bets made by each player before the first card of a game round is dealt from the shoe. Such detection and display can be made in real time before settlement of bets for a game round is made. In this embodiment, automatic recording or deal manual inputting of bet types and amounts per player is made before delivery of the first card from the shoe for each game round. A discrepancy between what the display shows per player and what is physically on the casino game table can be self-evident.

All references cited herein are incorporated by reference in their entirety, especially with respect to descriptions of apparatus and systems, game rules and methods.

BRIEF SUMMARY

The present invention is a novel system for enabling play of a casino card game. Systems of the present invention include a gaming table with a gaming surface, an automatic card shuffler capable of forming random sets of cards, and a "house way" display that provides the dealer, player or dealer and player important information on how to set each hand of cards. The information may be made available automatically, or may be made available in response to a user input request. The automatic card shuffler reads at least one of a rank and suit of each set of playing cards, so that sets of cards of known composition are delivered to the players and dealer. A processor is provided that contains house way hand-setting rules, receives set information and determines a house way to set the hand. This information is displayed to assist the dealer, player or dealer and player to set hands from the set of cards assigned to the player. The processor may be internal to the shuffler or external to the shuffler. The processor may also be programmed to calculate a house commission on winning hands. A user input allows the dealer to input the wager amount and the house commission and player payouts are calculated and displayed.

The automatic card shuffler is configured to deliver randomized sets of physical cards to a game position. A game position may be a player position, a dealer position, a common card position or other designated position on the layout. The shuffler is equipped with a playing card reading system that reads at least one of a rank and suit of markings on each of the playing cards. A processor receives the read card information from the playing card reading system and determines a composition of each individual set of playing cards dispensed.

The system includes a gaming table with a gaming surface and at least one electronic display or monitor on or proximate the gaming surface in communication with a processor programmed with house way rules for the particular game being controlled. The processor causes the display to display information on how to set hands from a distributed set of cards in a house way. The information can be displayed any number of ways, including: in the form of card rank and/or suit information, images of one or more hands formed from the set, and data files representing cards that are to be placed into one or more hands.

The present invention is also characterized as a method of operating a casino table card game using physical playing cards that are distributed in sets to multiple play positions. The method comprises the step of providing a complete set of playing cards for use in the casino table card game. An example of a complete set for the game of Pai Gow Poker is 52 standard cards, plus one joker. The method includes at least one player making a game wager on the casino table card game. Randomized sets of cards are delivered to each player and to the dealer from the complete set. Some games may require that only players receive cards and, in that instance, randomized cards are only delivered to players. Other games may use only common cards and the set of cards would only then be delivered to the common card position.

The method includes reading rank, suit or rank and suit of playing cards in each set of cards with a reader to provide rank and suit information for each set. This read card information is then communicated to the processor, and the processor stores the composition of each set of cards being dealt into the game into memory. Sets of cards are then dealt to each play position. According to the method, the processor stores set information for each play position. The processor is programmed with house way rules and determines a house way to set hands with cards from the set at each play position. Either automatically or upon player request, the processor sends data to be displayed as information on a monitor of the house way to set the hands. In one embodiment, the "house way" of only one set of cards is displayed at a given time in response to a dealer input of the player or dealer hand position. The player and/or the dealer sets the hands according to the displayed information. According to the invention, the display may be equipped with touch screen controls. A control is provided to input a command to request a house commission calculation. The system is configured to prompt the user to input a wager amount. The system then automatically calculates a commission due to the house and the net payout amount due to the player.

DETAILED DESCRIPTION

Figure 1:
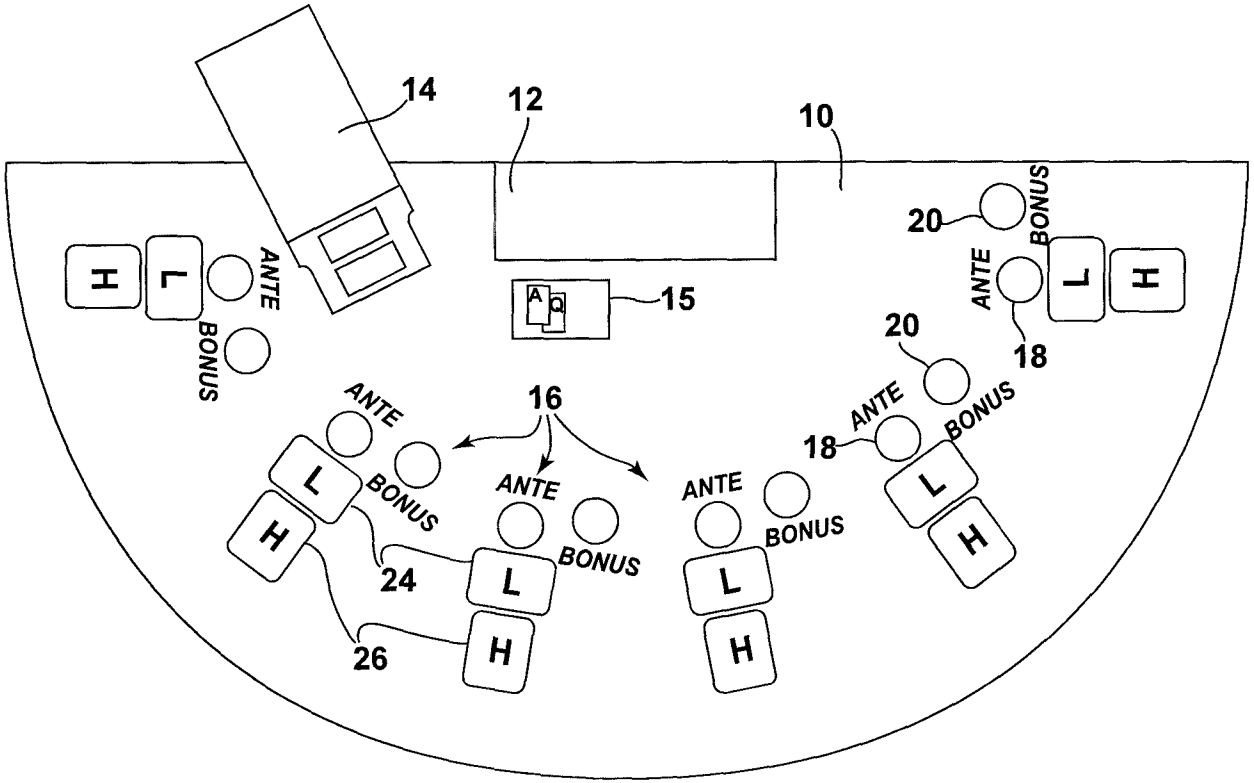
FIG. 1 is an exemplary system of the present invention, employing a gaming table, an automatic card shuffler and equipped with a "house way" display.

A system for enabling play of a casino table card game is disclosed, which is particularly useful in games where players, a dealer or both players and dealers must set hands of cards according to a complex set of house rules. According to the invention, card set composition is automatically determined, as well as the composition of a set of cards delivered to each play position. A play position for purposes of this invention is an area on a layout for a player, a dealer, a common area or other area designated for play purposes.

Preferably, multiple randomized sets of playing cards of known composition are formed and delivered to a game, and instructions for the dealer, player or dealer and player on how to set the hands the house way are provided on a display. Hands are set by following automatically generated and displayed house way instructions.

Systems of the present invention include an automatic card shuffler configured to deliver randomized sets of physical cards. The shuffler is equipped with a playing card reading system that reads at least one of a rank and suit of markings on each of the playing cards, wherein the automatic card shuffler has a processor that receives the read card information from the playing card reading system and determines a composition of each individual set of playing cards dispensed. The composition of each set is stored in the system's memory. One such shuffler is marketed under the brand name I-DEAL® and its structure and operation is disclosed in U.S. application Ser. No. 11/810,864, filed Jun. 6, 2007, now U.S. Pat. No. 8,070,574, issued Dec. 6, 2011, entitled "Apparatus, System, Method, and Computer-Readable Medium for Casino Card Handling," the content of which is incorporated by reference.

Exemplary systems of the present invention use a gaming table with a horizontal gaming surface, and provide at least one display, such as a video monitor on or proximate the gaming surface. A user input such as touch screen controls is provided in association with the display. In one example of the invention, the display is a video monitor and the monitor is flush-mounted into the gaming surface of the gaming table. In other embodiments, the video monitor is mounted proximate the gaming table, such as on a pole that is supported by the table structure. In other embodiments, house way setting instructions are automatically provided to players in video gaming formats.

The display is in communication with a processor programmed with house way rules for displaying instructions on how to set hands from a distributed set of cards a house way. In some embodiments, the game rules are also programmed into the processor. The processor is preferably internal to the shuffler but, in other embodiments, is external to the shuffler. The display is capable of displaying information on how to set a hand according to programmed house way rules. In one embodiment, the "house way" information is displayed when the dealer inputs a command. In other embodiments, the information is automatically displayed.

To reduce the expense of systems of the present invention, it is desirable to provide a community display that can be used to set player hands, and when the game requires a dealer hand, the same display may be used to set the dealer hand. In systems that use community displays, it is preferable to provide a menu of options whereby the dealer can input the selection of the set of cards to set. For example, if the dealer wants to set his own hand the house way, he would select the "dealer" set. If he then wanted to set the hand of the player in position 2, he would select "position 2" from the menu.

Once the set of cards is selected, the stored values that comprise this set of cards are retrieved from memory and the house way rules are applied to that set of values to determine how to set the hands. In the game of Pai Gow Poker, for example, the players and dealer receive seven (7) cards each. The present system preferably identifies the two cards that go into the low hand, and the remaining five (5) cards by default that go into the high hand. In this instance, the two computer-selected card values are displayed, and then the dealer or player arranges the cards, as permitted by house rules.

In other embodiments, the display instead displays the five cards that are to be assigned to the high hand, and the two cards that are not displayed by default are assigned to the low hand. In yet other examples, the composition of both hands is displayed. When the game is Pai Gow Poker, for example, the processor may be programmed to display a representation of a card of the suit and rank of each card in the two-card hand, five-card hand or both the two-card hand and five-card hand.

It is preferable to display a representation of a card to efficiently convey the information to the dealer and/or players. However, other forms of data may be displayed that can also convey the information. Examples include actual video images taken of all or part of the cards in the shuffler, or alphanumeric information of rank and/or suit values, for example.

In some embodiments, the house way rules reside in the shuffler processor. In other embodiments, the house way rules reside in an external processor. It is preferable to utilize the shuffler's processor to perform this function to avoid the cost of incorporating additional processing capability into the system, although other configurations are contemplated. The use of one or more processors in one or more locations to perform the disclosed functions is contemplated by the present invention. For example, the shuffler processor may control the executive functions of the shuffler and control the card reading system. The card reading output may then be input into a separate processor for determining how to set hands and, optionally, game outcome. In a preferred form of the invention, the shuffler function, card reading function, game rules, and house way rules are all managed by a single processor internal to the shuffler. The display may be equipped with some additional processing capability to control the appearance of the menu, and other button controls, for example.

Here in the game of Pai Gow Poker, there is no absolute and unique set of rules for setting hands. There are a number of ways that certain types of hands can be set, and it is a decision of each house or casino to decide on a specific set of rules. It is important that there be a fixed set of rules so that players do not feel that a casino is altering the way a specific hand is set to win a bet against a specific player hand.

It is therefore necessary to fix the particular house way at each casino, if they will not accept a standard version provided in the memory of the shuffler. It is also inconvenient to have to provide different house way sets of rules for every single variation, as there are at least fifteen (15) decision points in Pai Gow Poker and there are multiple options at a number of these decision points, so that thousands of different sets of rules would have to be provided.

To allow each casino the opportunity to more easily design its desired set of house rules, the following input data is provided in the form of a utility program, executed by a separate PC, for example, that is used to compile a custom "house way" rule set for a casino. The shuffler may be preprogrammed with a "standard" house way rule set that can be changed by utilizing the utility program. Data is selected on a case-by-case, decision-by-decision basis from the following chart, and the total identity of all the selections is compiled into the unique set of house way rules that the casino will use. The user is prompted to make a number of decisions by displaying decision points. The decision points are shown below:

Worksheet for Pai Gow Rules

Version 1.0.20

Property Name: _____

MEX = Alternate rule option

REQ = Required rule

OPT = Optional rules

Hand Settings:

Low pair hands: _2_ to ___

Med pair hands: ___ to ___

High pair hands: ___ to ___

Huge pair hands: ___ to _A_

Ace-Low Straight:

☐ A-5 is the second-highest straight

☐ A-5 is the lowest straight

Dealer Position:

☐ Seat 1

☐ Seat 7

Commission Calculator:

☐ Off

☐ On, using rate: _____% unit: _____

HIGH CARD

☐ REQ: Rule 32: No pair: Place the highest card in the back and the next two highest cards in the front.

---

ONE PAIR

☐ REQ: Rule 31: One pair: Place the pair in the back and the next two highest cards in the front.

---

TWO PAIR

☐ MEX: Rule 24a: L+L: Never split

☐ MEX: Rule 24b: L+L: Split unless K singleton or better.

☐ MEX: Rule 24c: L+L: Split unless A singleton.

☐ MEX: Rule 24d: L+L: Split unless A singleton or K + J or better singletons

☐ MEX: Rule 25a: L+M: Split unless K singleton or better.

☐ MEX: Rule 25b: L+M: Split unless A singleton.

☐ MEX: Rule 25c: L+M: Split unless A singleton or K + J or better singletons

☐ MEX: Rule 26a: L+H: Always split

☐ MEX: Rule 26b: L+H: Split unless A singleton.

☐ MEX: Rule 26c: L+H: Split unless A+J singletons or better

☐ MEX: Rule 27a: M+M: Split unless K or better singleton.

☐ MEX: Rule 27b: M+M: Split unless A singleton.

☐ MEX: Rule 27c: M+M: Split unless A+J singletons or better

☐ MEX: Rule 28a: M+H: Always split

☐ MEX: Rule 28b: M+H: Split unless A singleton.

☐ MEX: Rule 29a: H+H: Always split

☐ MEX: Rule 29b: H+H: Split unless A singleton.

☐ REQ: Rule 30: Huge+L/M/H/Huge or A+L/M/H/Huge: Always split

---

THREE PAIR

☐ REQ: Rule 23: Three Pair: Always split highest pair to low hand.

---

THREE OF A KIND

☐ REQ: Rule 22: Three of a kind: Play three of a kind in the high hand, unless three As then split one A to the low hand.

---

FULL HOUSE

☐ MEX: Rule 21a: With three of a kind and a pair: Always split and play the pair in the low hand.

☐ MEX: Rule 21b: With three of a kind and a pair: If pair is 2s and A+K singletons play A+K in low hand.

---

THREE OF A KIND WITH TWO PAIR

☐ REQ: Rule 20: With three of a kind and two pairs: Play the highest of the pairs in the low hand.

---

TWO THREE OF A KIND

☐ MEX: Rule 19a: Two Three of a kind: Always split the highest three of a kind as a pair to the low hand.

☐ MEX: Rule 19b: Two three of a kind: Split the highest three of a kind as a pair to the low hand unless 3 As then split one A to the low hand.

---

STRAIGHTS AND FLUSHES

☐ REQ: Rule 11: With full house: Use full house rule.

☐ REQ: Rule 12: With three of a kind: Split pair into low hand preserving the straight, flush or straight-flush ☐ REQ: Rule 13: With three pair: Use three pair rule.

☐ MEX: Rule 14a: With two pair: Use two pair rule.

☐ MEX: Rule 14b: With two pair: Use two pair rule unless the straight, flush or straight-flush can be preserved with any pair in low hand.

☐ MEX: Rule 14c: With two pair: Use the two pair rule if pair of aces and any other pair or both pairs are 10s or better or one pair is less than 10s with an ace singleton.

☐ MEX: Rule 14d: With two pair: Use the two pair rule if pair of aces and any other pair, or pair of Jacks and 6s or better, or any two pair and an ace singleton.

☐ MEX: Rule 14e: With two pair: Use the two pair rule if pair of aces and any other pair, or pair of Jacks and 7s or better, or any two pair and an ace singleton ☐ MEX: Rule 15a: With one pair: Place in low hand if a straight, flush or straight-flush can be preserved in the high hand.

☐ MEX: Rule 15b: With one pair 10s or better + Ace: Place pair in high hand and A with next highest singleton in the low hand.

☐ REQ: Rule 16: With one pair or two pair: Always play the one that allows the highest pair to be played in the low hand.

☐ OPT: Rule 17: With Ace and Joker: If five-card Ace high (10, J, Q, K, A) ST/ STFL (straight/straight-flush) contains a Joker, place pair aces in high hand and next highest in low hand.

☐ MEX: Rule 18a: Otherwise: Always play the one that allows the highest two cards to be played in the low hand.

☐ MEX: Rule 18b: Otherwise: With Straight and flush, use the highest hand that will allow a King or better singleton in the low hand otherwise play the Flush in the high hand.

---

FOUR OF A KIND

☐ MEX: Rule 5: 2 thru A: Apply two-pair rule.

☐ MEX: Rule 6: 2 thru 6: Never split, play in high hand

☐ MEX: Rule 7a: 7 thru A: Apply two-pair rule.

☐ MEX: Rule 7b: 7 thru 10: Split unless an Ace singleton can be played in the low hand.

☐ MEX: Rule 7c: 7 thru 10: Split unless an Ace + Jack or better singleton can be played in the low hand.

☐ MEX: Rule 7d: 7 thru 10: Split unless K better singleton can be played in the low hand.

☐ MEX: Rule 8a: 4 Jacks or better: Always split.

☐ MEX: Rule 8b: 4 Jacks through King: Split unless hand contains an Ace singleton played in low hand.

☐ MEX: Rule 9: 2 thru K: With 9s or less never split, with 10s or better split unless an A singleton can be played in the low hand.

---

FOUR ACES

☐ MEX: Rule 4a: 4 Aces: Always split.

☐ MEX: Rule 4b: 4 Aces: Split unless hand contains a pair of 7s or better

☐ MEX: Rule 4c: 4 Aces: Split unless hand contains a pair of Ks.

---

FOUR OF A KIND WITH PAIR

☐ MEX: Rule 3a: Four of a kind with pair: Play pair in low hand.

☐ MEX: Rule 3b: Four of a kind with pair: play pair in low hand, unless four Jack through King plus pair of 9s or less then split ☐ MEX: Rule 3c: Four of a kind with pair: Use the highest pair in the low hand.

---

FOUR OF A KIND WITH THREE OF A KIND

☐ MEX: Rule 2a: Four of a kind with a three of a kind: Split pair from three of a kind in the low hand.

☐ MEX: Rule 2b: Four of a kind with a three of a kind: Split pair from three of a kind in the low hand, but always split four aces unless the three of a kind is Kings.

☐ MEX: Rule 2c: Four of a kind with a three of a kind: Split the highest pair in the low hand.

---

FIVE ACES

☐ MEX: Rule 1a: 5 Aces: Always split.

☐ MEX: Rule 1b: 5 Aces + K pair: Do not split, use Ks in low hand.

The details of the options at each decision point may be compiled and programmed into the shuffler itself, or may reside on a separate computer with the house inputting its choices before the rule set is compiled and installed in the shuffler. The software may be installed before or after the shuffler is placed on the table. The decision tree resulting from the selection may be stored in memory at a central location or on a memory stick, and, for example, downloaded to all of the shufflers having the house way capability provided on the shuffler or on the table. In this way, a customized set of house way rules can be provided throughout a casino without having to execute the entire range of selections on each shuffler. Additionally, the house may change single decision entries at some later time without having to reload the entire decision tree.

One aspect of the present system is the fact that the players may be offered an option, and, are not required, to see what the dealer house way arrangement of a particular player hand would be, and then may elect to accept the house way arrangement or arrange the hand according to the player's choice. This execution of process steps can be performed as follows:

The underlying wagers are placed by a player in a Pai Gow Poker game or variant with side bet options. The seven playing cards for each hand is dealt, with the cards being read by the gaming system at the table. There is either a central screen viewable and accessible to each player and/or the dealer, with icons on the screen for each player position and the dealer position where pressure applied to touch screen controls will activate the execution of the display of the house way for a particular hand that has been read by the gaming system. That hand arrangement will then be displayed on the screen in a way that is readable by the player (cards are generally vertically symmetrical, so that both the player and the dealer can easily read the cards) and the player may, after viewing the house way arrangement, make a further election to accept the house way or to rearrange the hand by his own choice.

The house way display system in one example of the invention is connected to the shuffler and is in two-way communication with the shuffler, either directly or through an intermediate processor system or lower level intelligence system such as an ASIC or FPGA. Any table with the SHFL entertainment, Inc., I-DEAL® shuffler can be retrofitted with the commission calculation system and the house way direction system disclosed herein. Also, gaming table systems that have built-in touch screen displays, such as that described in U.S. patent application Ser. No. 12/218,583, filed Jul. 15, 2008, now U.S. Pat. No. 8,262,475, issued Sep. 11, 2012, as referenced above can be retrofitted with the SFHL entertainment, Inc., I-DEAL® shuffler programmed with the enabling software for the commission calculation and the house way indication software. Alternatively, the "house way" functionality may be incorporated into a game controller and the information can be displayed on an existing player or dealer display and interface rather than on an additional common display dedicated to displaying house way hand setting instructions.

In one preferred form of the invention, the display is equipped with touch screen controls or another conventional user input device programmed to require the dealer to input a request for setting a hand the house way. It is also preferable that the dealer first select the hand to be set from a menu of multiple available hands. For instance, the dealer could choose a dealer hand or any one of six player positions at a Pai Gow Poker table. In response to a dealer input, the "house way" information is then displayed. Requiring the dealer to call for this information has advantages. First, it may be obvious to the dealer how to set the hand and asking for this information would cause an unnecessary delay in the game. Second, revealing the information on how to set the hand before the player has had a chance to think about his choices might discourage play. To maintain the ambiance of the game, the dealer needs to control the timing of the delivery of this important information.

Typically, the dealer would input a request for information on how to set the hand. However, in other embodiments that will be described in more detail below, the player is provided with controls for calling for the information. The information in this example could alternately be displayed on a player display, or a dealer display rather than on a common display.

An automated system of controlling the play of a table game using live cards and electronic player wagering is described below that incorporates features of the present invention into a player display.

The present invention may also be characterized as a method of operating a casino table card game using physical playing cards that are distributed in sets to at least one play position. Examples of play positions include player positions, a dealer position, a common card position or other designated positions on a gaming table layout. The method includes the step of providing a complete set of playing cards for use in the casino table card game. The complete set may be a deck of cards, multiple decks of cards, special decks of cards or one or more decks with one or more extra cards such as a bonus card or a joker. When the method is used to operate a Pai Gow Poker game, the preferred set of cards is a standard 52-card deck, with one additional Joker. The standard deck includes four suits (Spades, Diamonds, Hearts and Clubs), three court cards per suit (Jack, Queen, King), and an Ace, 2, 3, 4, 5, 6, 7, 8, 9, and 10 of each suit.

According to the method, each player makes a game wager to participate in the casino table card game. When the game is Pai Gow Poker, additional bets may be made available, such as bonus side bets, odds-based side bets and progressive side bets, with or without envy and/or bad beat bonuses.

After the wagers are in place, randomized sets of cards are delivered to each player and to the dealer from the complete set of cards. It is preferable that the randomized sets be formed internally in a hand-forming shuffler, capable of reading the rank and suit of the cards to determine the composition of the set of cards, and that is also capable of retaining set composition information within the shuffler. In other forms of the invention, the hands are formed manually after the shuffler or other card-handling device reads the rank and suit, but this method is less preferable because the dealer must input the set composition information into the shuffler or external computer in order to electronically store set information. It is also contemplated to use additional sensing devices on the table, such as an "end round" dealer input in order to provide a processor sufficient information to determine which cards that have been scanned should be assigned to each set. Clearly the most advantageous way to electronically gather set composition information is to scan the cards in a shuffler that securely shuffles and forms hands internally and produces a data file of set composition.

According to the method, the rank and suit of playing cards in each set of cards is read with a reader to provide rank and suit information for each set. This is preferably accomplished during shuffling, but could alternatively be accomplished by reading cards exiting a shoe, reading cards after cards have exited a shoe, reading cards as the cards are passed over a scanner or inserted into a "no-peek" type device, by overhead imaging and by other known methods.

Once the cards are scanned, the method includes the step of communicating the rank and suit information to a processor so that the processor can assemble set composition data. The sets of cards are preferably dealt to each player position (and other play positions as required by the rules of the game) after being scanned, but in alternative embodiments, cards are scanned at the player position after delivery.

The method includes the step of the processor identifying each individual card in each individual set dealt to each play position. This step may be accomplished by receiving the set composition data from the shuffler processor and storing this data in memory. The memory can reside in the shuffler or be memory associated with an external processor. The processor used to perform the method is programmed with compiled house way rules and determines a house way to set hands with cards from the set at each play position. The house way rules are preferably compiled using a utility program that prompts the user to select from a menu of house way options. Either automatically or upon player request, the processor sends data to be displayed as information on a monitor of the house way to set the hands. An additional step of the present invention is for either the player, the dealer, or both the player and dealer, distributing cards from the set into the hands according to the displayed information.

When the method is practiced for administering the game of Pai Gow Poker, a total of seven cards are delivered to each player and the dealer play positions. The dealer, the player, or the dealer and player refer to automatically displayed information that is used to set the hands. This displayed information advantageously speeds up game play by assisting the player and dealer in setting hands from the set of delivered cards without having to remember complex house rules or without having to consult with another player or the dealer in setting the hand.

Figure 7:
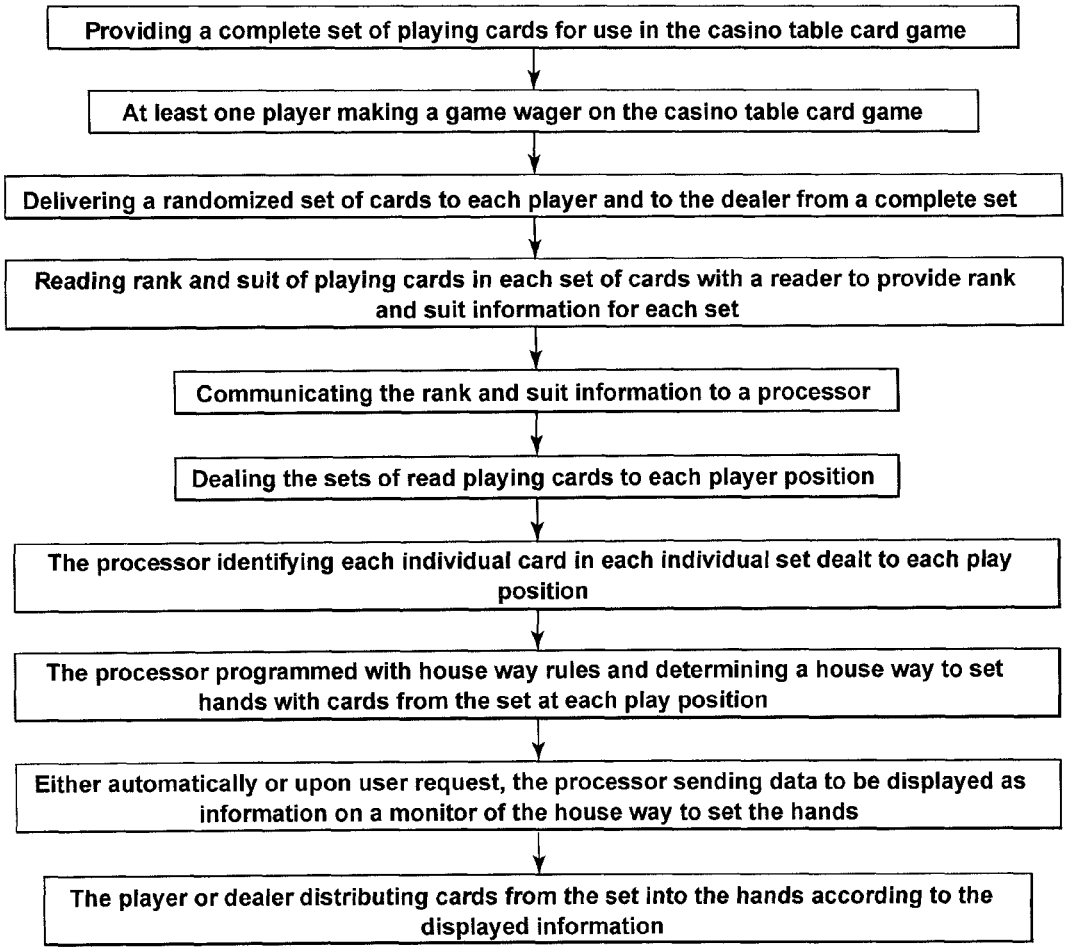
FIG. 7 is a flow diagram of a method according to technology disclosed herein.

House rules that relate to setting hands in Pai Gow Poker vary from casino to casino. It is to be understood to those skilled in the art that known variations of house rules can be programmed and that all variants are contemplated by the present invention. The various steps described above of methods of the present invention are shown diagrammatically in FIG. 7.

The following information assembled in Table 1 provides an exemplary table of hand outcomes and relative rankings for the game of Pai Gow Poker.

TABLE 1

| The following five-card poker rankings are used to determine game outcome in the game of Pai Gow Poker: | |
|---|---|
| | Rank of Hands |
| 1. | 5 Aces w/Joker |
| 2. | Royal Flush |
| 3. | Straight Flush<br>A-2-3-4-5 is the second highest straight<br>9-10-J-Q-K is the third highest straight |
| 4. | Four of a Kind |
| 5. | Full House |
| 6. | Flush |
| 7. | Straight<br>A-2-3-4-5 is the second highest straight<br>9-10-J-Q-K is the third highest straight |
| 8. | Three of a Kind |
| 9. | Two Pair |
| 10. | One Pair |
| 11. | High Card |

In addition, the ranking of the high hand must exceed the ranking of the low hand. Low hands are ranked by pairs, then by individual cards, with a pair of Aces being the highest hand and a hand of a 2, 3 the lowest possible hand (a pair of twos would beat all high card hands).

TABLE II

| Dealer's Cards | 1st Rule | 2nd Rule | 3rd Rule | 4th Rule | 5th Rule |
|---|---|---|---|---|---|
| No Pair | Use highest ranked card in the high hand and the 2nd and 3rd highest rank cards in the low hand. | | | | |
| 1 Pair | Always use the pair in the high hand. | | | | |
| 2 Pair | Definition of Hands<br>Low Pair: 2-5<br>Medium Pair: 6-10<br>High Pair: J-K<br>Ace: A | Always split Aces and any other pair. | High-High: Always Split<br>High-Med: Always Split<br>High-Low: Always Split unless an Ace can be played in the low hand. | Med-Med: Always Split unless an Ace can be played in the low hand.<br>Med-Low: Always Split unless an Ace can be played in the low hand. | Low-Low: Always split |
| 3 Pair | Always use the highest pair in the low hand. | | | | |
| 3 of a Kind | Always use 3 of a kind in high hand except 3 Aces then split and use one Ace in the low hand. | | | | |
| Two 3 of a Kind | Always break the higher 3 of a kind to use in the low hand. | | | | |

TABLE II-continued

| Dealer's Cards | 1st Rule | 2nd Rule | 3rd Rule | 4th Rule | 5th Rule |
|---|---|---|---|---|---|
| Straight | Use the straight in the high hand. With a six-card straight use the highest card in the low hand. | With one pair, use the pair in the low hand if the straight can be preserved. | Separate straight with: 1) Pair of J, Q, K & pair of 6 or higher. 2) Pair of Aces & any other pair. 3) 2 Pair & Ace using 2 pair in high hand (e.g.,: A223345 = 22334 – A5). | With 3 of a Kind, play the pair in the low hand. | |
| Flush | Use the flush in the high hand. | Exception to rule 1: With a six-card flush, use the high card in the low hand. | Exception to rule 1: With a six-card flush and a pair, use the pair in the low hand. | Note: Choose straight over flush when A or K can be used in the low hand. | |
| Full House | Always split full house unless low pair is twos and hand contains A or K, then use full house in high hand. | | | | |
| 4 of a Kind | Use 4 of a kind as high hand if it is sixes or lower. | Use 4 of a kind as high hand if it is sevens to tens unless an Ace or a pair can be played in the low hand. | Always split Jacks or higher. | With 4 of a kind and a pair, always play the pair in the low hand. | |
| Straight Flush | Use the straight flush in the high hand. | Exception to rule 1: With a six-card straight flush use the highest card in the low hand. | Exception to rule 1: With a six-card straight flush and a pair on either end, use the pair in the low hand. | Split straight flush with: 1) Pair of J ,Q, K & pair of 6 or higher. 2) Pair of Aces & any other pair. 3) 2 Pair & Ace using 2 pair in low high hand (e.g.,: A223345 = 22334 – A5). | Played same as straight. |
| Royal Flush | Always play in high hand unless there are 2 pair of tens or higher then split. | | | | |
| 5 Aces | Always split unless you have a pair of K then use KK in the low hand. | | | | |

The following table describes one exemplary set of compiled "house way" hand setting rules for the game of Pai Gow Poker:

Systems of the present invention enable game play using physical cards. In other embodiments, the systems are used in connection with play on multi-player gaming machines, single player gaming machines, wireless gaming platforms, Internet gaming, gaming on PCs for practice play and the like. The following examples describe how systems and methods of the present invention can be incorporated into gaming platforms that require the use of physical cards. An exemplary multi-player gaming platform that can be used to practice the present invention is disclosed in U.S Patent Publication 2005/0164759 A1, the disclosure of which is hereby incorporated by reference.

EXAMPLE I

Apparatus used to practice the present invention is described below in several examples. As shown in FIG. 1, in this example of the invention, a gaming table 10 is provided with a substantially flat gaming surface. The gaming table 10 may be equipped with a standard chip tray 12, a hand-forming, card reading shuffler 14, and a house way electronic display 15 with touch screen controls. On the gaming surface are printed markings designating player areas 16. Each player area 16 bears markings for placement of a low hand 24, placement of a high hand 26, the placement of an Ante wager 18, and optionally the placement of a bonus wager 20. The shuffler 14 is computer controlled (not shown). The house way display 15 in this embodiment does not contain processing capability. In other embodiments, the house way display 15 is processor controlled, and the processor controls the touch screen controls, and the appearance of the data presented on the screen.

During play, players place an Ante wager in region 20, and the dealer activates shuffler 14 to deliver pre-made, randomized sets of seven (7) cards each into the game. According to traditional dealing practice, six player hands are delivered, (and the dealer hand) regardless of how many players are participating in the game. The dealer inputs the player position via touch screen controls on the house way display 15 to activate the system to determine how that player's hand should be set. The display then displays the two cards that should be assigned to the low hand on the house way display 15. The player or the dealer, depending upon casino rules, places those cards in the low hand area 24. The remaining cards go into the high hand area 26.

This technology may be used for any type of game that requires the setting of hands from a set of cards. If, for example, the card game requires the player to set three hands from the set of cards, the house way display 15 would provide enough instructions to dictate how the hands should be set. For example, when the player sets three hands, the display must identify cards that go into at least two of the three hands. The remaining cards form the last hand.

The house way display 15 is preferably located in an area that is central to the gaming table surface, in view of all players. The dealer is the only person authorized to input commands or elections to the display. House rules dictate whether the dealer or the player must then set the cards according to the displayed information. In one embodiment, the player is required to set his own hand. The house way instruction may be followed or may be ignored. However, players will generally improve their chances of winning by following house way instructions.

EXAMPLE II

In this next example, the present technology is incorporated into a gaming platform that enables card play using physical cards, but electronic wagering instead of wagering with currency or chips. Since each play position includes a display with a wagering interface and a touch screen input for making play decisions, this player display and input interface can also be used to request and receive house way hand setting information.

Figure 2:
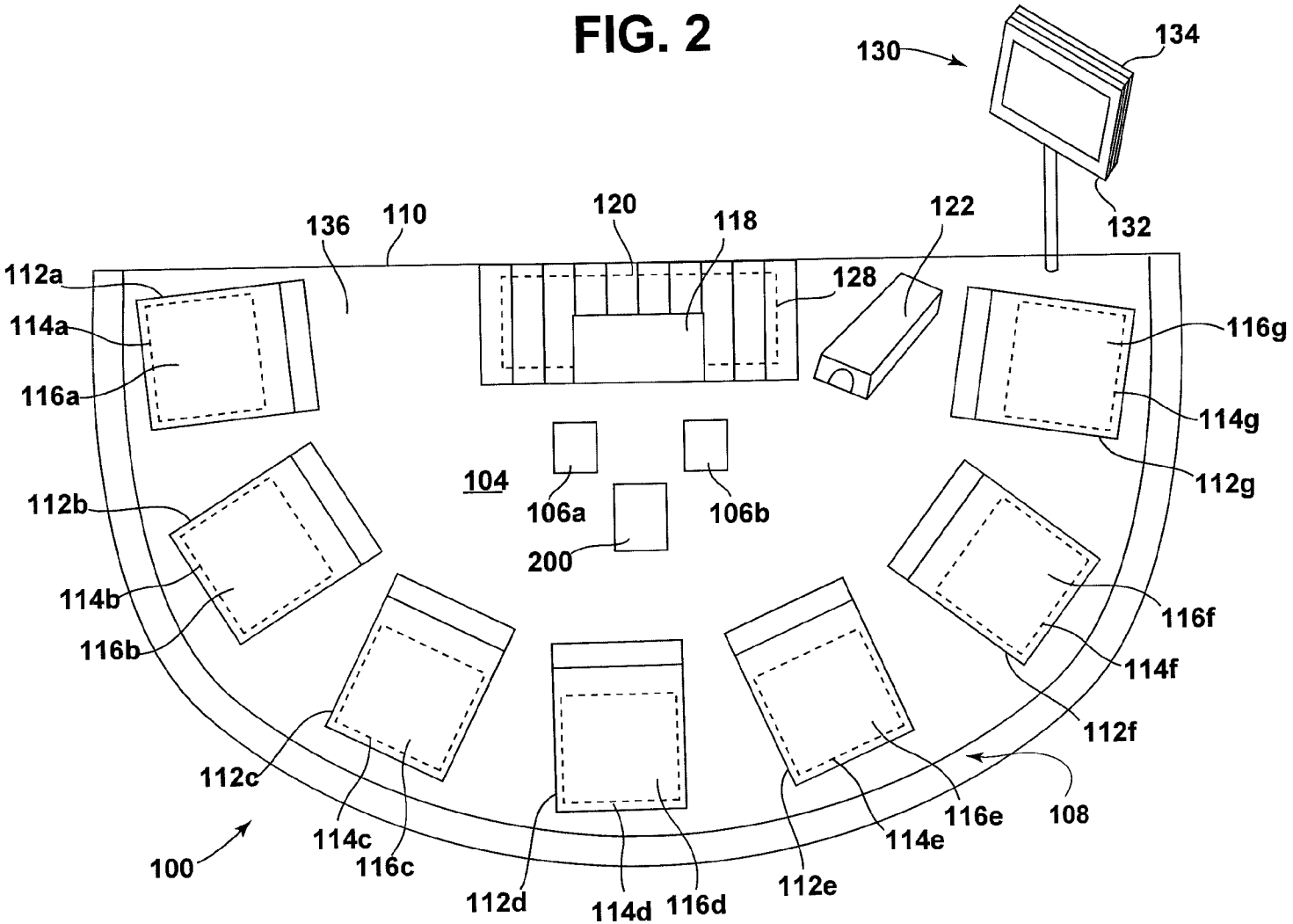
FIG. 2 is an exemplary electronic gaming platform, or chipless gaming table, according to one aspect of the invention.

In this example, as shown in FIG. 2, the gaming platform is an electronic, processor-based system, using physical playing cards, a card-handling device with card reading capability, and electronic player wagering interfaces. Such a system is more thoroughly described in U.S. patent application Ser. No. 12/218,583, filed Jul. 15, 2008, now U.S. Pat. No. 8,262,475, issued Sep. 11, 2012, which is incorporated by reference herein. Each individual player position has a monitor on which information may be displayed. As cards are randomly assigned/distributed to each player position in a game in which the playing cards may be arranged into multiple hands in the same game, information may be provided to each player through the individual player monitors, on the "house way" of playing the hand. That is, the player is provided specific information on how all of the cards could be arranged in the manner selected by the House (the casino) to provide the highest potential for the play to follow ideal strategy. Players may use information that is automatically provided with each hand. In other embodiments, the information is not displayed until after the player inputs a request for the information and the player has the option to ask or not ask for the information. The player also has the option to use or not use the information in some embodiments.

A chipless gaming table 100 system is provided for playing live card games with physical playing cards (e.g., playing cards 106*a* and 106*b*) according to technologies enabled and disclosed herein. Gaming table 100 can be a variety of common constructions or configurations as are typically used as the structural components of gaming table in the industry. The typical gaming table has a tabletop or playing surface 104 and a perimeter pad or armrest 108, which extends at least about the portion of a table periphery 110 facing the players. The relatively straight back portion of the periphery 110 is used by the dealer (not shown) and can be partly or wholly padded as may vary with the particular table chosen. Seven player display/input systems 112*a*-112*g* are shown. Each of the player input systems 112*a*-112*g* has a processor 114*a*-114*g* (shown in phantom) and a touch screen entry surface 116*a*-116*g*. There may be an optional dealer chip tray 120.

There is also a game controller, CPU or casino computer 128 (shown in phantom) whose location at the gaming table 100 is relatively unimportant, but which must be in direct (hardwired or wireless or networked) communication with each individual player processor 114*a*-114*g* and a card reading and/or card delivery system 122, preferably a card-handling device such as a shoe or a shuffler with integrated card recognition technology, from which playing cards are supplied, with at least a rank/count (and preferably also suit) of individual cards known as the cards are removed (for example, one-at-a-time) and delivered to player positions and/or the dealer position. The card delivery system 122 shown in this example of the invention is a card-reading shoe, such as the shoe that is fully disclosed in U.S. patent application Ser. No. 12/291,909, filed Nov. 14, 2008, now U.S. Pat.

No. 8,490,973, issued Jul. 23, 2013, entitled "Card Reading Shoe with Card Stop Feature and Systems Utilizing the Same," the content of which is incorporated by reference. The card delivery system 122 is in communication with controller 128 by wired or wireless communication methods. Chipless gaming table 100 may further comprise a more centrally located display 200, which is also in communication with game controller 128 and preferably includes a random number generator. Display 200, or the house way display, may provide information to the player and dealer with instructions on how to set their hand according to house rules. In other embodiments, the individual player displays 112*a*-112*g* display house way information for players, and the community display 200 displays house way information for the dealer. The individual processors 114*a*-114*g* could also be in communication link with the game controller 128 by wireless or hardwired connections. Communication is not limited to electronic or electrical signals, but may include optical signals, audio signals, magnetic transmissions or the like.

The playing surface 104 is provided on the table where participants of the card game(s) play. One or a plurality of players (not shown) sit or stand along the semicircular portion and play a desired card game requiring the player, dealer, or both player and dealer to set hands. The gaming table 100 also advantageously includes a betting chip rack or tray 120 that allows the dealer to conveniently store betting chips used by the dealer in cashing players in and out of the game. A money drop slot (not shown) is further included to allow the dealer to easily deposit paper money bills therein when players purchase credits.

Table 100 can support a system, or form a part of a system, for playing live card games that is constructed according to the present invention. The card game system described herein, in one example, is a retrofit system that has been added to a standard gaming table support frame. Such a retrofit system includes an upright communal player display 130, which displays images that depict game information such as pay table, hand counts, win/loss information, historical win/loss information by player, and a wide variety of other information considered useful to the players. The display 130 is a two-sided display that will be explained more fully below.

The system also preferably includes a dealer control 118 that is preferably provided in the form of a display with touch screen controls positioned within the chip rack 120. In an alternative embodiment, the dealer control 118 resides on the card dispensing device 122 or as a separate keypad (not shown). The individual player position processors are preferably graphics processors 114*a*-114*g* and not full content CPUs as a cost saving, space saving, and efficiency benefit. With the reduced capacity in the processor as compared to a CPU, there is actually a reduced likelihood of tampering and fraudulent input.

The "chipless table" format and architecture described herein comprises generic concepts and specific disclosure of components and subcomponents useful in the practice of the present technology. It should be appreciated at all times that equivalents, alternatives and additional components, functions and processes may be used within the system without deviating from the enabled and claimed technology of this invention.

One preferred construction of a chipless table has from three to eight players (shown in FIG. 2 as seven player positions) with five, six or seven Player betting positions 112*a*-112*g* (with independent monitors 114*a*-114*g*) being preferred, a Dealer control 118, a double-sided table sign (shown in FIG. 2 as 130, with a front player exposed screen 132 and a casino pit directed screen 134), a card reading shoe 122 (or card reading shuffler, overhead camera imaging system or table mounted card reader—not shown), a chip tray 120, cards 106*a*, 106*b*, a generic felt 136 and a table computer 128 using the AQUARIUS CONTROLLER™ protocol (game controller, for under the table, manufactured by Progressive Games, Inc. of Las Vegas, Nev.).

The game information (which is preferable for multiple games) is configurable and will be set up during the initial installation of the table and may be switched from game to game on-the-fly at each table. It is from the set-up that the game information is selected so that the graphics on the player touch screen 116*a*-116*g* are displayed. Dealer console 118, pit display 134 and table display 132 provide the correct information regarding the game in play. It is the capability of changing individual types of game events (e.g., from blackjack to Pai Gow Poker) at a table that enables, or even requires, that the generic felt 136 is free of any permanent printing that identifies only a specific game at a table. There may be separate monitors (not shown) that enable display of game names, game rules and pay tables for individual games, or under table back-lighting that may project such information display on the table.

Using the pit display 134, the game is selected by casino personnel and communicated to the table controller 128 via a touch screen control on the pit display 134. The table controller 128 (and/or a central pit controller) sends out the appropriate graphics to each of the player screens and table signs to begin game play.

Figure 3:
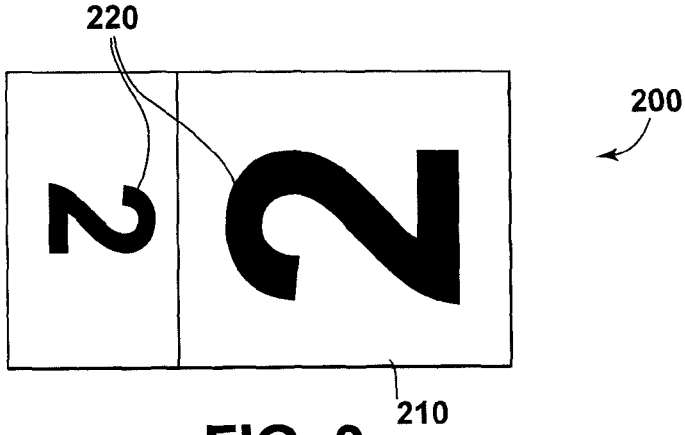
FIG. 3 is an exemplary screen layout that shows a randomly selected player starting position for delivering the first set of cards in a game of Pai Gow Poker.

FIG. 3 shows an exemplary "house way" display screen, generally referred to as numeral 200. Preferably, display 200 is a touch screen display with a touch screen surface 210. When the game being played is Pai Gow Poker, the display 200 may include a random number generator display or receive a signal from game controller 128 or card-handling device 122, which also may provide randomly generated numbers. Alternatively, the information shown in display 200 may be incorporated into dealer console 118. The random number generator is used to identify the first player to receive a set of cards.

In this example, randomly selected number 220 is the number two. This instructs the dealer to begin dealing cards to the player seated in the number two position of player input system (i.e., 112*b* as shown in FIG. 2) for games such as Pai Gow Poker where there is no predetermined starting position. For ease of viewing by the player and the dealer, a large icon of randomly selected number 220 is oriented toward the player and a smaller icon is oriented in the direction of the dealer. The initial screen with randomly selected number 220 will remain displayed until a signal is received that cards have been delivered from card-handling device 122 to at least one player and the dealer.

Once cards are dealt to at least one player and the dealer, the "house way" display 200 changes to allow the dealer to input a decision showing which set of cards at the table to assign to or set into hands. The dealer makes the decision and inputs this decision into the touch screen controls by touching one of the areas one to six or DEALER area. This input causes the screen to change again as shown in FIG. 5 to show the elected set, and the card backs face-down 260 of the two cards that have been selected by the processor to be assigned to the low hand.

Figure 4:
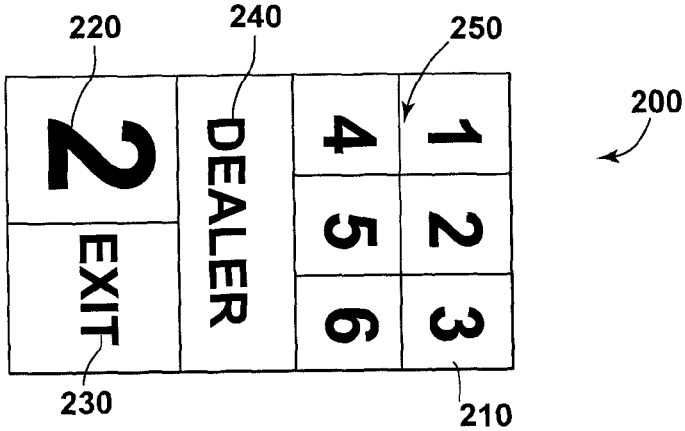
FIG. 4 is an exemplary screen layout that shows how to select the set of cards for purposes of obtaining house way hand setting information.

In FIG. 4, the user may input a decision to elect which hand to set. Card-handling device 122 senses the rank and suit of the cards in the set prior to delivery.

The signal received by "house way" display 200 not only includes rank and suit of cards, but card set information for each set. At this point, the user has the option to select "Dealer" button 240 or one of the player position buttons 250, in this example, identified as numbers one through six, on touch screen surface 210. Exit button 230 is provided to return the user to the previous screen. While it is understood that the "buttons" on touch screen surface 210 are electronic likenesses thereof, mechanical buttons could also be used without deviating from the scope of the invention.

Figure 5:
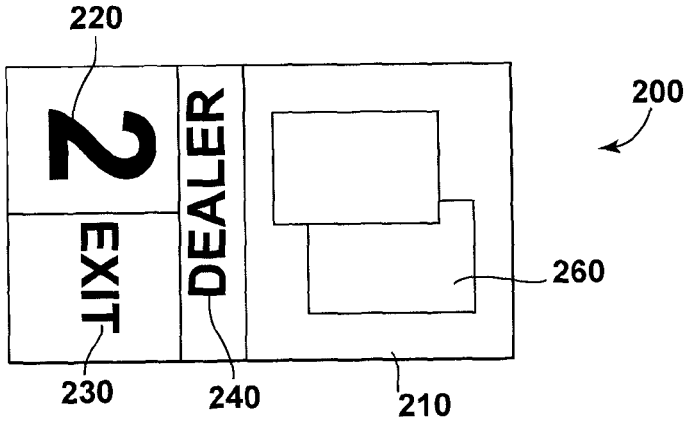
FIG. 5 is an exemplary screen layout that shows that the dealer hand has been selected, with the low hand cards displayed face-down.

As shown in FIG. 5, the user has selected to display the house way of setting hands for the dealer hand by depressing "Dealer" button 240 on touch screen surface 210 of display 200. This example illustrates setting a hand for Pai Gow Poker, in which the players and the dealer each receive seven cards to form two hands. Two cards form the "low" hand and the remaining five cards form the "high" hand. Display 200 now shows an electronic representation of the two cards which form the dealer's low hand, with the card faces concealed, or face-down 260. In this fashion, the casino ambience is preserved by not yet revealing the dealer hand and also gives the user an opportunity to exit back to the previous screen, via exit button 230, to select a player hand to display. In this example, only the low hand is displayed according to the house rules of setting a hand. By default, the remaining five cards comprise the high hand. In alternate embodiments, the high hand could be displayed, or both hands could be displayed.

Figure 6:
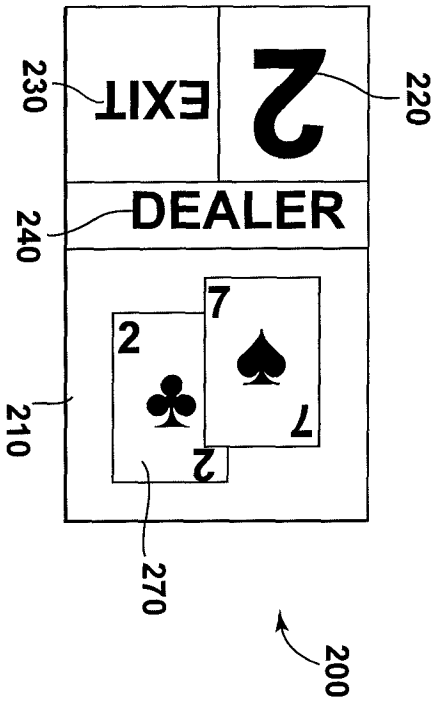
FIG. 6 is an exemplary screen layout that shows the dealer's low cards face-up, indicating how to set the dealer hand according to the house way.

FIG. 6 shows the dealer's low hand, with cards face-up 270, revealing the house way of setting the dealer's hand. While it is contemplated that the house way of setting hands is automatically calculated when the hand information is received by game controller 128, the calculation could be delayed until the user manually depresses the appropriate buttons on touch screen surface 210 of display 200 if desired.

The house way display options shown in FIGS. 3-6 may be used on a live gaming table application as shown in Example I.

Gaming devices of the present invention utilize at least one processor, such as a microprocessor, a microcontroller-based platform, a suitable integrated circuit or one or more application-specific integrated circuits (ASICs) or Field Programmable Gate Arrays (FPGAs). The processor is in communication with or operable to access or to exchange signals with at least one data storage or memory device, the playing card delivery system and/or the individual player monitors. In one embodiment, the processor and the memory device reside within the cabinet of a gaming device dedicated to each table or networked to each one of multiple tables. The memory device stores program code and instructions, executable by the processor, to control the gaming device. The memory device also stores other data such as image data, event data, player input data, card set data, random or pseudo-random number generators, pay-table data, hand hierarchy, house way rules and applicable game rules that relate to the play of the gaming device.

In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes Flash memory and/or EEPROM (electrically erasable programmable read only memory). Any other suitable magnetic, optical, and/or semiconductor memory may operate in conjunction with the gaming device disclosed herein. In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example, part of a wireless gaming system.

In some embodiments, the gaming machine may be a handheld device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In some embodiments, the gaming device randomly generates a player position designation, or awards and/or other game outcomes based on probability data. In one such embodiment, this random determination is provided through utilization of a random number generator (RNG), such as a true random number generator, a pseudo random number generator, or other suitable randomization process. In one embodiment, each player position selection, award or other game outcome is associated with a probability and the gaming device generates the selection, award or other game outcome to be provided to the player based on the associated probabilities. In this embodiment, since the gaming device generates outcomes randomly or based upon one or more probability calculations, there is no certainty that the gaming device will ever provide the player with any specific selection, award or other game outcome. The use of physical playing cards read by the card delivery device, especially using randomized (shuffled) sets of cards to provide the playing cards in the card delivery device, reduces the use of RNGs in the performance of the process, as the randomization of the playing cards (even if in part effected through the use of RNGs in a shuffling device) reduces the immediacy of the use of RNGs in the operation of the present gaming system.

Figure 8:
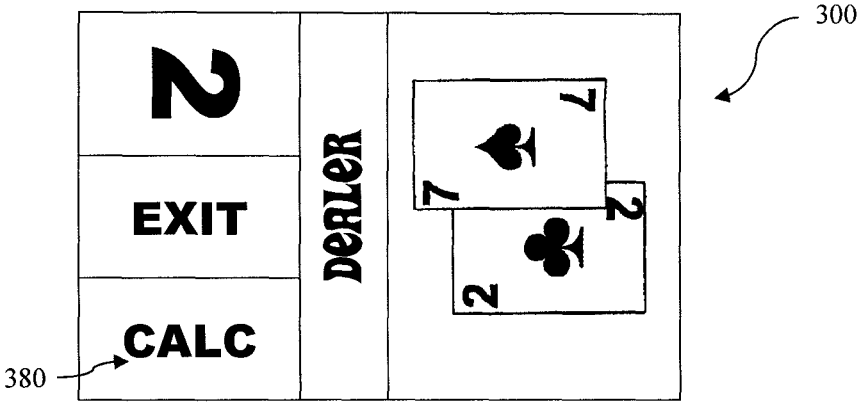
FIG. 8 is a screen shot of an example of the present invention that illustrates a commission calculation feature.
Figure 9:
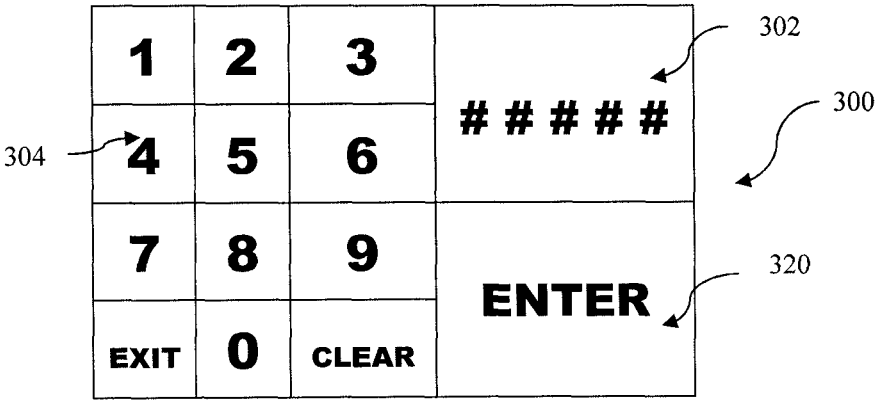
FIG. 9 is a screen shot of an example of the present invention that illustrates a wager input function.

In one example of the invention as shown in FIG. 8, a house commission calculation feature is provided. The dealer enters an input on display 300 by pressing the "calc" button 380. When the "calc" input is made, the screen appearance changes as shown in FIG. 9 to allow for the input of a wager amount on keypad 304. After the amount has been entered, the dealer presses the "enter" button 320 and the amount wagered is displayed in area 302.

Figure 10:
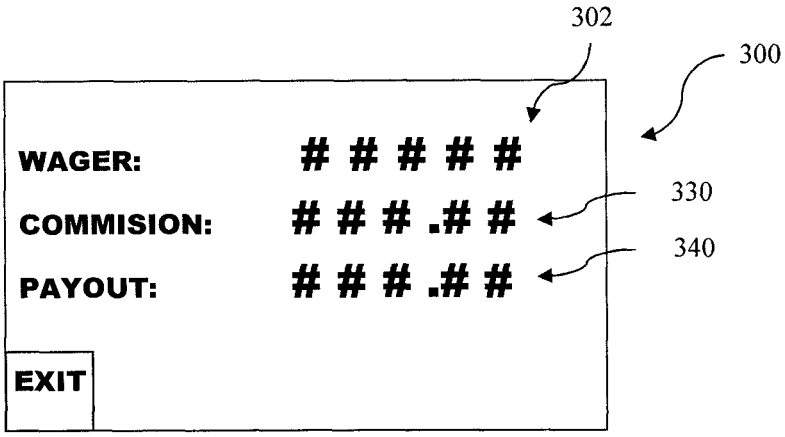
FIG. 10 is a screen shot of an example of the present invention that illustrates inputted amount wagered, calculated house commission, and payout amount to the player.

The processor then applies the entered data to an algorithm to determine a house commission amount 330 and a player payout amount 340, as shown in FIG. 10. The calculated amounts are displayed on the screen 300.

Figure 11:
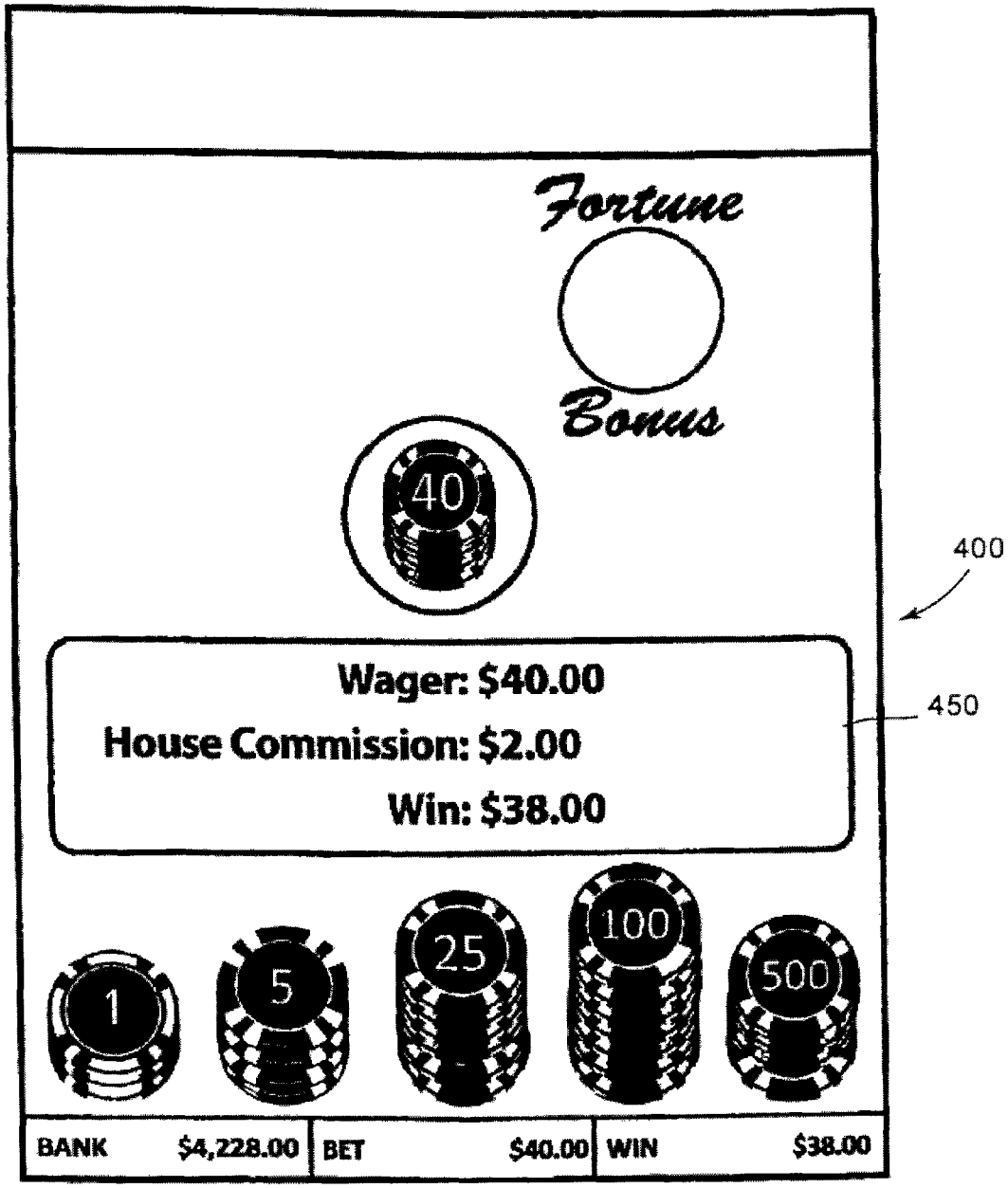
FIG. 11 is a screen shot of an electronic player interface illustrating house commission and payout amount calculations.

In one example of the invention, the algorithm to determine the house commission is a user-input commission rate, typically 5%. The wager amount is multiplied by this rate and divided by 100 to arrive at the commission amount. The payout is equal to the wager amount minus the commission. In other examples of the invention, such as shown in FIG. 11, this information may alternately be displayed on a player display 400 in the form of a pop-up display 450. The illustrated display 400 allows electronic wagering and is part of SHFL entertainment, Inc.'s i-TABLE® gaming platform.

One advantage of incorporating the commission calculator feature into a system with electronic wagering interfaces is that the commission paid to the house can be exact amounts, rather than denominations that are convenient for the house. Players can become agitated from paying commissions that exceed a typical rate of 3% to 6%, and more typically, 5% when they are wagering amounts that have commission amounts that do not equal a denomination that can be easily handled by the dealer, such as a 25 cent coin.

In the next example, algorithms are employed that assign wagers within defined ranges a fixed commission amount, to aid the dealer in quickly resolving wagers and collecting commissions. This type of algorithm may be used when the players are wagering with chips, markers and/or currency, to make it easier for the dealer to collect commissions and make change, when needed. For example, if at the end of a play session a player owes the house $19.75 in fixed commissions, the house can take four, five dollar chips and return a 25 cent value token.

There is another aspect to the present technology that provides the casino, the dealer and the players with a significant advantage in the play of the game. Embodiments of the present invention may be used to educate the players on how the house commissions are determined, increasing the players sense of fairness in the game. To many players, these commissions are not well understood, as they are taken on various different bases, such as the amount of a wager (with different ranges of wagers having different commissions in baccarat, rather than a specific fixed percentage). Other games, such as poker, take the commission after the dealer sees that at least minimum specific total amounts of wagers have been made. Therefore, a player may be confused or even irritated when small wager changes cause significant changes in commissions. For example, in Pai Gow Poker, a typical commission is $0.25 on wagers between $1.00 and $25.00, and $0.50 on wagers between $26.00 and $50.00. Therefore, the commission doubles in raising a wager from $25.00 to $26.00. The lack of clarity and apparent randomness of the commissions creates a negative feeling in some players.

In the present display system described herein, it is possible to provide a request function or automatic function regarding the commission to be taken in a game. The display can show an abbreviated explanation of the commission. For example, when the system identifies a player winning event for player 3 at a Pai Gow table with a $20.00 wager, the display can show the commission as "$1.25" alone, or can display "$1.25 for wagers at or below $25.00." Similarly, for player 4 at the Pai Gow table, with a winning event and a $70.00 wager, the display may show either "$3.75" or "$3.75 for wagers between $51.00 and $75.00." This commission display may be automatic with all player winning events or may be requested on a hand-by-hand basis, either by the dealer (especially if a player requests an explanation) or by a player touching an icon on the display screen when his win is shown on the screen. The commission or rake taken by the house is approximately 5%, and provides the house with an approximately 1.57% of the house edge. Using an algorithm that compares the wager amount to determine if it is within a pre-determined range of values allows the house to take commissions in wager denominations that are available at the table. For example, the algorithm may test the wager to determine if the amount is between 0 and 25 and if "yes," apply a $1.25 house commission. If "no," it will test to see if the wager is between 26 and 50 and if "yes," will assess a commission of $2.00. If "no" it will test to see if the wager is between 51 and 75, and if the answer is "yes," it will apply a $3.75 wager. By assessing fees in multiples of 025, the dealer can more easily collect these amounts and more importantly, make correct change.

In the play of this feature, when a time in the play of a game calls for a player to set or arrange the player's hand into a particular final hand or hands, a series of alternatives/procedures within the scope of the presently disclosed technology may be effected. For example, in Pai Gow Poker, it is common for the player's hand furthest clockwise or furthest counter-clockwise at the table to be the first player to compete with the dealer's hand by disclosing cards. The gaming system at the table is aware of the playing cards provided to that first player and that player position is identified by a position indicator (usually 1, 2, 3, 4, 5, 6 and 7 are used for all player positions and the dealer position at a Pai Gow Table, with the dealer's position usually indicated as "1"). The game system is aware of which first player hand will be revealed and accesses the memory of the cards read for that hand during the resolution of the wagers. The dealer may also use a touch screen or button function to indicate a specific hand position that will be resolved against the dealer hand. For example, when the dealer presses "Player Position 2," that player position 2 hand will be displayed on the screen. If the house way arranging function is active, then that player position 2 hand is displayed in a set order, with a house way distribution between the High hand and/or the Low hand shown on the screen. At that point, the player may elect (by spoken word, arrangement of cards, or pressing a touch screen icon) the house way arrangement or to set the cards in a player selected arrangement.

In some embodiments of the invention, win/loss information is tracked automatically and the game rules are programmed into a game controller that receives data input from the house way input screen. In that instance, the player's individual election may be easily entered into the system by the dealer arranging the virtual cards by touching playing cards and sliding the virtual image of the cards into the player selected positions. Upon entering this new arrangement of cards, the dealer may "close" the arrangement of the hand by pressing another icon or button to officially set that player's hand. After a first player's hand has been set, the dealer would then proceed to resolve a next player's hand, as by touching an icon on the touch screen or pressing a button that now indicates the next player's hand is to be considered, with the house way distribution being addressed as with the first player's hand. This procedure will proceed through all players' hands. In the case where there is a Dragon Bonus hand (a hand of seven residual, unplayed cards dealt along with the original cards and on which at least one player may make a wager in addition to his own wager), or if there is only one player making a wager on the Dragon Bonus hand, the hand may be played as any player's hand. Where two or more players wager on the Dragon Bonus hand, it may become a rule that only the house way may be used to eliminate debates among players on how to set the hand.

If an individual player arrangement is made, the dealer may resolve the wager based on traditional objective comparison, or input data on the players hand arrangement into the game processor to have the processor and programmed game rules determine the outcome.

Although some casinos allow players to wager the commission, where a $21.00 wager would pay $20.00 for a win, that alternative is objectionable because the players do not like to lose a commission when they lose, and can better tolerate a commission when they win.

The presently claimed technology may include at least the following. A system is described that enables play of a casino table card game in which at least one of a rank and suit of a set of playing cards is automatically determined, multiple randomized sets of playing cards of known composition are formed and delivered to players in the game and to a dealer in the game, and the dealer's cards are set by following displayed house way instructions. The structure of the system includes:

a) an automatic card shuffler that shuffles playing cards and delivers randomized sets of physical cards. The shuffler is equipped with a playing card reading system that reads at least one of a rank and suit of markings on each of the playing cards. The automatic card shuffler has a processor (distally in communication or in the shuffler itself) that receives the read card information from the playing card reading system and determines a composition of each individual set of playing cards dispensed;

b) a gaming table with a gaming surface; and c) at least one video monitor on or proximate the gaming surface in communication with a processor programmed with house way rules for displaying instructions on how to set hands from a distributed set of cards according to a house way;

wherein the monitor displays information on how to set a hand according to programmed house way rules for the dealer's hand and for players' hands, and the monitor is configured with an information input system to display instruction on players' hand setting according to the house way. The video monitor may display prompts to calculate a house commission on a hand.

The casino table card game enabled is preferably Pai Gow Poker and the processor may be programmed to display a rank, suit or rank and suit of a two-card low hand. A player input may enable a player to elect to display information on how to set a hand. The processor is programmed to display a rank, suit or rank and suit of a five-card high hand, or a two-card low hand or both. The processor may be programmed to receive a dealer input instruction from a touch screen or buttons to display an arrangement of playing cards for a particular player position, either automatically as each wager is resolved or by dealer/player input identifying the specific player position. The processor has information on a wager amount from a specific player position (either by automatic wager reading (i.e., RFID), dealer input or player input on an electronic wagering input device). The display provides displayed information on a commission that is taken from the wager amount when a player hand has a winning event. In one embodiment, information on how the commission is calculated is also displayed. The system in the play of Pai Gow Poker has the shuffler deliver randomized sets of seven cards each and the processor has an input file of decisions made in setting hands in a house way during a Pai Gow game, and at a time during play of the game, the processor causes an arrangement of a player's hand to be displayed according to the file of decisions input into a five-card hand and a two-card hand from the randomized seven cards in the player's hand. The video monitor may be flush-mounted into the gaming surface, or pole-mounted proximate the gaming surface.

The system includes memory that stores the composition of each set of cards and preferably stores card set information for a period of time, such as storing the data for 24 hours in case of any disputes. The processor programmed with house way rules may be the same or different processor that controls the card shuffler. In some embodiments, the processor is further programmed with game rules for determining game outcome from the read hands and configured to determine resolutions of wagers, including removal of commissions from winning wagers.

The system may further comprise a dealer input that allows the dealer to request a display of instructions for setting a particular hand of cards at the table in the house way.

Another description of this technology is a system for enabling play of a casino table card game in which at least one of a rank and suit of a set of playing cards is automatically determined, a commission is taken by a house, multiple randomized sets of playing cards of known composition are formed and delivered to players in the game and to a dealer in the game, and the dealer's cards are set by following house way instructions. A method of use of the system may include:

an automatic card shuffler shuffles playing cards and delivers randomized sets of physical cards, the shuffler equipped with a playing card reading system that reads at least one of a rank and suit of markings on each of the playing cards, wherein the automatic card shuffler has a processor that receives the read card information from the playing card reading system and determines a composition of each individual set of playing cards dispensed;

a gaming table with a gaming surface; and at least one video monitor on or proximate the gaming surface in communication with a processor programmed with house way rules for displaying instructions on how to set hands from a distributed set of cards according to a house way;

wherein the monitor displays information on how to set a hand according to programmed house way rules for the dealer's hand and for a players' hands, the monitor configured with an information input system to display instruction on the players' hand setting; and wherein the information on an amount of a player's wager on the game is input to the processor, and the processor determines a commission and causes the monitor to display an amount for the commission on the amount of the player's wager.

In this type of a method, a dealer requests through a dealer input a display of instructions for setting a particular hand of cards at the table in the house way and display of the amount for the commission is shown either before resolution of the wager, at the same time as resolution of the wager or after resolution of the wager for the player. Alternatively, the house way instructions are displayed in response to a user input.

A method of operating a casino table card game using physical playing cards that are distributed in sets to multiple play positions may have the following series of steps, although the steps are not always restricted to the order shown in the list below:

a complete set of playing cards is provided for use in the casino table card game, which in the play of Pai Gow Poker is a standard 52-card deck plus one joker and these are shuffled and read by a shuffler such as the SHFL entertainment, Inc., I-DEAL® shuffler;

at least one player makes a game wager on the casino table card game;

a randomized set of cards is delivered to each player and to the dealer from the complete set;

rank and suit of playing cards in each set of cards is read with a reader to provide rank and suit information for each set;

the rank and suit information is communicated to and stored for a processor;

the sets of read playing cards are dealt to each player position;

the processor identifies each individual card in each individual set dealt to each play position;

the processor has been programmed with house way rules and determines a house way to set hands with cards from the set at each play position;

either automatically or upon user request, the processor sends data to be displayed as information on a monitor of the house way to set the hands; and the player or dealer distributes cards from the set into the hands according to the displayed information.

The house way rules are initially determined according to a decision tree and a file of all decisions made in the decision tree are saved in memory and the memory of the file is saved in the memory of the processor and used in displaying the information on the monitor.

A preferred way of performing the above method is where the casino table card game is Pai Gow Poker, and a formed set of seven physical cards is provided to each player and the dealer and the house way includes arrangements into a two-card low hand and a five-card high hand, and the monitor also displays information from the processor on an amount of commission to be taken out of a winning player's resolution based on amount of the player's wager. Systems of the present invention may be incorporated into an all-electronic gaming platform such as the system described in U.S Patent Publication No. 2005/0164759 A1, the content of which is incorporated by reference. Those systems enable electronic multi-player game play and are particularly well-suited for the play of interactive, multi-player card games such as Pai Gow Poker.

Card values are randomly determined and virtual cards are displayed on a community display. When the game is Pai Gow Poker, the player's "house way" instructions may be displayed on the common display, or on a player specific display. The player may touch and drag virtual cards to set the hand, based on the house way advice. The player may choose to set the hand his/her own way, ignoring the house way rules. The device may alternatively be programmed to display house way rules to players only on request. In the all-electronic embodiment, no dealer house way rules are displayed, instead the dealer hand is automatically set the house way.

Utility programs of the present invention may compile house way rules that can be loaded into the memory of the game CPU so that the house can customize the game rules to comply with preferred house way rules. This process assures that the house's profit on an electronic version of the Pai Gow Poker game will be the same as the profit on a live game with the same wager maximum and minimums.

When the player wins, it is preferable to display the player wager amount, the house commission amount and the player payout amount. In other embodiments, information on how the house commission is calculated is also displayed.

Although specific games, specific equipment, specific process steps and specific numbers have been used in providing an enabling description of the present technology, it must be understood that this disclosure is intended to be generic in nature and that the specifics provided are examples, not necessarily limits, on the scope of technology claimed herein.

What is claimed is:

1. A system for enabling play of a casino table card game in which at least one of a rank and suit of a set of playing cards is automatically determined, multiple randomized sets of playing cards of known composition are delivered to players in the game, the system comprising:

a card handling device configured to deliver randomized sets of physical playing cards, the card handling device equipped with a playing card reading system for reading at least one of a rank and suit markings on each of the playing cards, wherein the card handling device is operably coupled to a processor to receive the read card information from the playing card reading system and programmed to determine a composition of each individual set of playing cards delivered;

a gaming table with a gaming surface; and at least one video monitor associated with the gaming table in communication with a processor programmed with rules on how to set hands from delivered randomized sets of cards and operable to display information to assist at least one of a dealer and a player in arranging respective players' hands received from the processor programmed with the rules.

2. The system of claim 1, wherein the casino table card game enabled is Pai Gow Poker and the processor is programmed to cause the at least one video monitor to display a rank, suit or rank and suit of a two-card low hand.

3. The system of claim 2, wherein the processor is programmed to cause the at least one video monitor to display a rank, suit or rank and suit of at least one of a five-card high hand and a two-card low hand.

4. The system of claim 1, wherein the casino table card game enabled is Pai Gow Poker and the processor is programmed to receive a dealer input instruction from a touch screen or buttons to cause the at least one video monitor to display an arrangement of playing cards for a particular player position.

5. The system of claim 1, wherein the processor is operable to access information on a wager amount from a specific player position and to cause the at least one video monitor to display information on a commission that is taken from the wager amount when a player hand comprises a winning event.

6. The system of claim 1, wherein the card handling device is configured to deliver randomized sets of seven cards each and the processor has access to a compiled file of decisions made in arranging hands according to the rules during a Pai Gow game and, at a time during play of the game, and the processor is programmed to cause an arrangement of a player's hand to be displayed according to the compiled file of decisions into at least one of a five-card hand and a two-card hand from the randomized sets of seven cards in each player's hand.

7. The system of claim 1, wherein the at least one video monitor is flush-mounted into the gaming surface.

8. The system of claim 1, wherein the at least one video monitor is pole-mounted proximate the gaming surface.

9. The system of claim 1, wherein the composition of each set of cards is stored in memory.

10. The system of claim 1, wherein the processor programmed with the rules on how to arrange hands is the processor of the card handling device.

11. The system of claim 6, wherein the compiled file of decisions is compiled using a separate utility program.

12. The system of claim 10, wherein the processor is further programmed with game rules for determining game outcome.

13. The system of claim 1, further comprising a dealer input that enables the dealer to request a display of information for arranging a particular hand of cards at the gaming table according to the rules.

14. A method of operating a casino table card game using physical playing cards, the method comprising:

providing a complete set of playing cards for use in the casino table card game;

receiving a wager on the casino table card game from one or more game positions;

forming a randomized set of cards for each of the one or more game positions from the complete set;

reading a rank and suit of playing cards in each randomized set of cards with a reader;

communicating the read rank and suit information for each randomized set to a processor;

the processor identifying each individual card in the randomized set dealt to each of the one or more game positions;

the processor programmed with rules for determining one or more ways to arrange a hand with cards from the randomized set at each of the one or more game positions; and the processor sending data to be displayed as information on at least one monitor of the one or more determined ways to arrange the hand.

15. The method of claim 14, wherein the rules are initially determined according to a decision tree and a file of all decisions made in the decision tree is compiled and saved in memory accessible to the processor and used in displaying the information on the at least one monitor.

16. The method of claim 15, further comprising compiling the file of all decisions made in the decision tree using a separate utility program.

17. The method of claim 14, further comprising storing a composition of each randomized set of cards in memory.

18. The method of claim 14, wherein the processor sending data to be displayed as information of the one or more determined ways to arrange the hand on the at least one monitor is automatic.

19. The method of claim 14, wherein the processor sending data to be displayed as information of the one or more determined ways to arrange the hand on the at least one monitor is responsive to dealer request.

20. The method of claim 14, further comprising the processor determining an outcome of the casino table card game according to game rules.

* * * * *